US006006644A

United States Patent [19]

Matsuo et al.

[11] Patent Number: 6,006,644

[45] Date of Patent: Dec. 28, 1999

[54] MINE TREATMENT METHOD AND MINE TREATING APPARATUS

[75] Inventors: Shinji Matsuo, Hyougo-ken; Tomotaka Ishikawa, Gunma-ken, both of Japan

[73] Assignee: Nissan Motor Co., Ltd., Kanagawa-ken, Japan

[21] Appl. No.: 09/139,657

[22] Filed: Aug. 25, 1998

[30] Foreign Application Priority Data

Aug. 26, 1997 [JP] Japan ..... 9-229916

[51] Int. Cl.[6] ..... B64D 1/04; A01B 13/00

[52] U.S. Cl. ..... 89/1.13; 37/303

[58] Field of Search ..... 89/1.13, 1.1; 37/301, 37/302, 303; 171/56, 50

[56] References Cited

U.S. PATENT DOCUMENTS

| | | | |
|---|---|---|---|
| 1,114,505 | 10/1914 | Moore | 408/129 |
| 2,014,311 | 9/1935 | Council | 55/18 |
| 2,549,476 | 4/1951 | Johnson | 294/50.8 |
| 3,800,715 | 4/1974 | Boller | 109/49.5 |
| 5,349,500 | 9/1994 | Husseiny et al. | 89/1.11 |
| 5,553,405 | 9/1996 | Hayashi et al. | 37/189 |
| 5,715,614 | 2/1998 | Ookuwa et al. | 37/302 |

FOREIGN PATENT DOCUMENTS

| | | | |
|---|---|---|---|
| 3928082 A1 | 8/1988 | Germany | 89/1.13 |
| 1018348 | 11/1997 | Germany . | |

*Primary Examiner*—Charles T. Jordan
*Assistant Examiner*—Jeffrey Howell
*Attorney, Agent, or Firm*—McDermott, Will & Emery

[57] ABSTRACT

A mine treatment method for treating a mine placed in the ground includes a step of freezing the soil around the mine; and a step of digging up the mine together with the frozen soil. The method may further include a step of making water penetrate into the soil around the mine before the step of freezing the soil. In the method, the soil around the mine is frozen by liquefied nitrogen. After the soil around the mine is frozen, the mine is dug up together with the frozen soil from the ground.

7 Claims, 4 Drawing Sheets

MINE TREATMENT METHOD AND MINE TREATING APPARATUS

BACKGROUND OF THE INVENTION

1. Field of the Invention

This invention relates to a mine treatment method for use in treating a mine placed in the ground and a mine treating apparatus.

2. Description of the Related Art

Currently, there are a considerable number of unexploded mines all over the world attracting a lot of international public attention presently treatment of mines mostly depends on hand work. That is, a mine is found by hand work or using a mine detector and then that mine is dug out from the ground. After its fuse is removed, it is exploded.

Alternative devicer for treating miner includes using a mine field exploding apparatus that is currently available. According to the mine field exploding apparatus, a bomb containing an explosive is launched by a rocket to a mine field and exploded so as to induce explosion of mines placed nearby.

According to the above described conventional mine treatment method, the hand work includes inherent danger. In case of the mine field exploding apparatus, this can be used only in an environment permitting a rocket to be fired and there is a fear that all mines are not induced to explode, and further there is a problem that mine parts are left. A solution for these problems has been tried in the conventional art.

SUMMARY OF THE INVENTION

The present invention has been developed with such points in mind.

It therefore is an object of the present invention to provide a mine treatment method and mine treatment apparatus that are capable of safely removing a mine placed in the ground.

To achieve the above object, according to a first aspect of the present invention, there is provided a mine treatment method for treating a mine placed in the ground, comprising the steps of: freezing the soil around the mine; and digging up the mine together with the frozen soil.

According to the mine treatment method of the above first aspect of the invention, since the soil around the mine is frozen and dug out, the mine can be safely removed in an inoperative condition. Thus, the safety level is much higher than the case of treatment by human hand. Additionally, unlike the mine field exploding apparatus using a rocket, the environment is not restricted. Furthermore, because there is no fear that mine parts are left in the ground, the ground, which was before a mine field, can be transformed to agricultural field without any special treatment.

According to a second aspect of the present invention, as it depends from the first aspect, the soil around the mine is frozen by liquefied nitrogen.

According to the mine treatment method of the above second aspect of the invention, because liquefied nitrogen is used for freezing the soil around the mine, a sufficient freezing is carried out and treatment cost is cheap. Furthermore, the efficiency of freezing is improved, therefore, the length of time needed to perform the treatment can be shortened.

According to a third aspect of the present invention, as it depends from the first or the second aspect, the mine treatment method further comprising a step of: making water penetrate into the soil around the mine before the step of freezing the soil.

According to the mine treatment method of the above third aspect of the invention, because water is made to penetrate into the soil and the soil around the mine is frozen, freezing is progressed not only from the surface of the soil but also inside thereof so that the freezing effect is accelerated. Therefore, the length of time needed to perform of the treatment can be further shortened.

According to a fourth aspect of the invention, there is provided a mine treating apparatus, comprising: a freezing chamber having an opening portion opening downwardly; and a driving body to drive the freezing chamber into the ground, wherein the freezing chamber includes: digging teeth which extend from the side portion thereof toward the inside of the opening portion; and a freezing fluid supply portion to supply freezing fluid into the internal space of the freezing chamber.

According to the mine treating apparatus of the above fourth aspect of the invention, after a mine is detected, the freezing chamber is driven into the ground by the driving body so as to encase the mine inside of the apparatus, then the digging teeth are extended from the side portions of the freezing chamber to the inside of the opening portion thereof and the mine is taken into the inside of the freezing chamber together with the surrounding soil. Then, by supplying freezing fluid to the internal space of the freezing chamber from the freezing fluid supply portion, the soil around the soil is frozen and after that, the freezing chamber is lifted up by the driving body so as to dig the mine together with the soil. As described above, because this mine treating apparatus digs the mine after the surrounding soil is frozen, the mine can be safely removed in an inoperative condition with the safety.

According to a fifth aspect of the invention, as it depends from the fourth aspect, the freezing chamber further includes: an internal cylinder having a circular horizontal section; and an external cylinder having a circular horizontal section, the external cylinder having an inside diameter at the bottom end portion thereof which is substantially same as an outside diameter at the bottom end portion of the internal cylinder, wherein the digging teeth are a pair of spherical teeth; and the digging teeth extend toward the inside of the opening portion through a groove-like releasing portion formed between the bottom end portions of the internal cylinder and the external cylinder in a rotating manner.

According to the mine treating apparatus of the above fifth aspect of the invention, the digging teeth are accommodated between the internal cylinder and external cylinder constituting the side portion of the freezing chamber. At this time, the inside diameter of the bottom end portion of the external cylinder is of substantially the same structure as the internal cylinder. Therefore, the freezing chamber is smoothly driven into the ground without the digging teeth interfering with the ground. Further, because a pair of the digging teeth are formed in spherical shape and rotatably supported and the digging teeth are extended or retreated through the groove-like releasing portion open toward the inside of the opening portion, the digging teeth can be extended smoothly in the ground so that the mine and surrounding soil can be taken into the freezing chamber securely.

According to a sixth aspect of the invention, as it depends from the fourth or the fifth aspect, the freezing chamber further includes circular digging teeth at the bottom end portion; and the driving body supports the freezing chamber in such a manner that the freezing chamber is rotatable around the vertical axis of the freezing chamber.

According to the mine treating apparatus of the above sixth aspect of the invention, because the freezing chamber has the circular digging teeth at the bottom end thereof and the driving body supports the freezing chamber so that it is rotatable around a vertical axis, if the freezing chamber is rotated around the vertical axis to drive the freezing chamber into the ground by the driving body, the soil is dug with the digging teeth thereby enabling smooth digging operation. Furthermore, since tremble affecting the mine can be reduced, the treatment of the mine can proceed with high safety and rapidity.

According to a seventh aspect of the invention, as it depends from one aspect among the fourth aspect to the sixth aspect, the freezing chamber has a water supply portion to supply water into the internal space thereof.

According to the mine treating apparatus of the above seventh aspect of the invention, because the freezing chamber has a water supply portion for supplying an internal space with water, by supplying the internal space of the freezing chamber with water from the water supplying portion so as to make water penetrate into the soil before the soil around the mine is frozen, an effect of freezing the soil around the mine is accelerated. Therefore, the time of the treatment can be further shortened.

According to an eighth aspect of the invention, as it depends from one aspect among the fourth aspect to the seventh aspect, the freezing chamber and driving body are loaded on a moving means.

According to the mine treating apparatus of the above eighth aspect of the invention, because the freezing chamber and driving body are loaded on the moving means, this apparatus can be operated solely as, for example, a mine treating vehicle, so that an excellent mobility by which the treatment of the mine can be proceeded on the mine located anywhere is ensured.

BRIEF DESCRIPTION OF THE ACCOMPANYING DRAWINGS

The above and further objects and novel features of the present invention will more fully appear from the following detailed description when the same is read in conjunction with the accompanying drawings, in which.

Figure 4A:
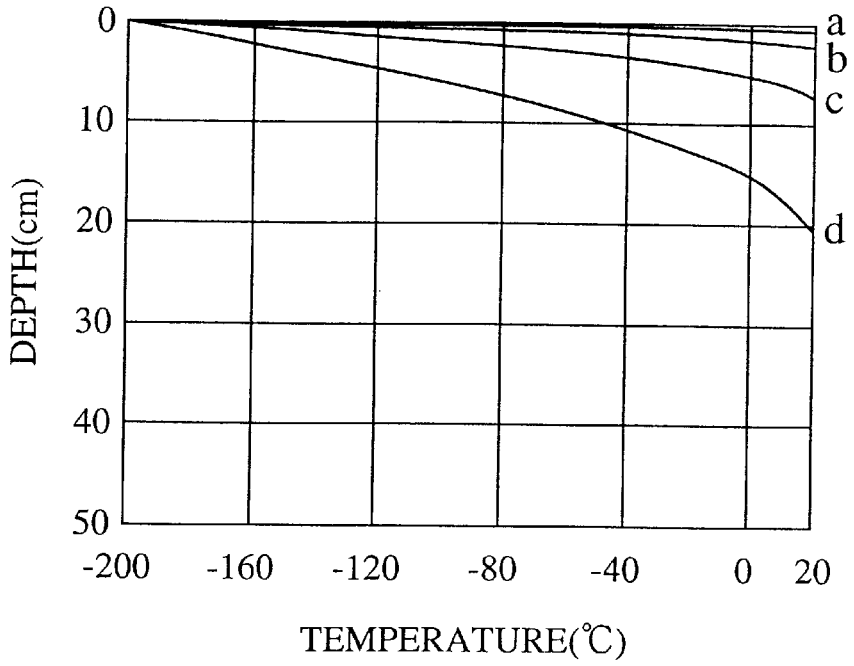
Figure 4B:
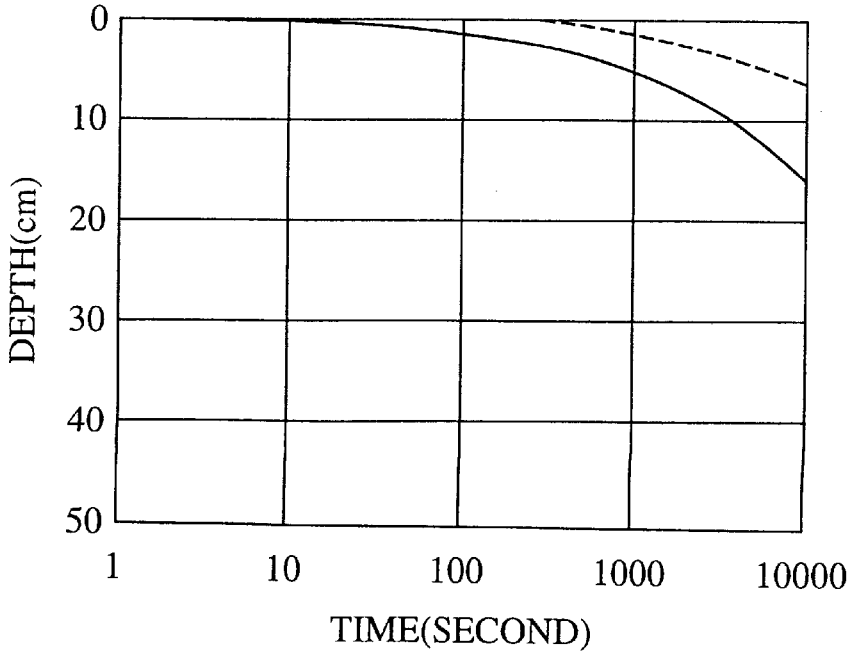

FIG. 4A shows a graph indicating a relation between a depth of the ground in the center of the freezing chamber and a temperature with a passage of time, in an operation of freezing the soil; and FIG. 4B shows a graph indicating a relation between the depth of the ground in the center of the freezing chamber and 0° C. arrival time and a relation between a distance from the side portion of the freezing chamber and the 0° C. arrival time.

DETAILED DESCRIPTION OF THE PREFERRED EMBODIMENTS

There will be detailed below the preferred embodiments of the present invention with reference to the accompanying drawings. Like members are designated by like reference characters.

Figure 3A:
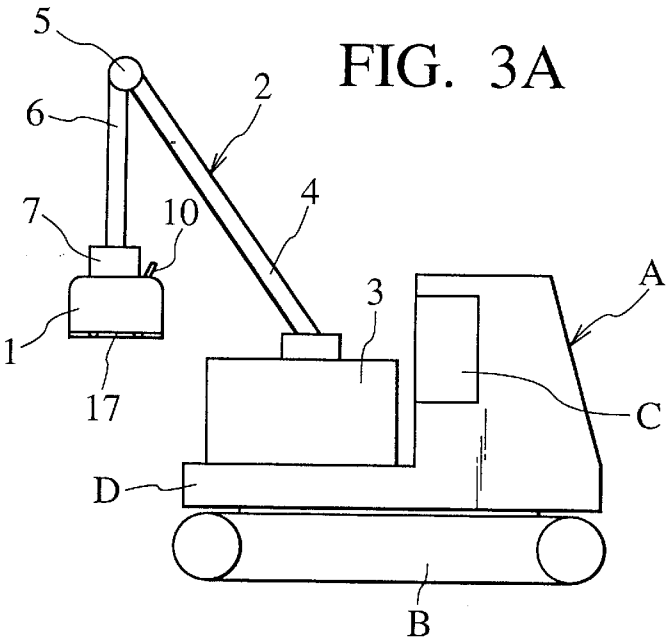
FIGS. 3A, 3B, 3C, 3D, 3E and 3F show explanatory diagrams for explaining steps of mine treatment with operations of a vehicle as a moving means.

A mine treating apparatus is loaded on a vehicle A operating as a moving means as shown in FIG. 3A and comprises a freezing chamber 1 which is open downward and a driving body 2 for driving the freezing chamber 1 into the ground. The vehicle A has track B and the driving body 2 is mounted on a deck D provided in front of a cab C.

The driving body 2 comprises a main body 3 accommodating a driving source (not shown), liquefied nitrogen tank, water tank and the like and provided on the deck D of the vehicle A, an arm 4 the proximal end of which is rotatably supported on top of the main body 3 and a driving shaft 6 the upper end of which is connected to an end of the arm 4 through a universal joint. The freezing chamber 1 is provided coaxially with the driving shaft 6 at a lower end thereof.

The arm 4 and driving shaft 6 are of expandable hollow body and internally accommodate a water supply pipe stretching from a water tank of the main body 3 to the freezing chamber 1 and a driving force transmitting mechanism for driving digging teeth which will be described later such that they are capable of following the expansive motion. The driving shaft 6 is capable of rotating axially by a rotation driving source, for example, provided in the universal joint 5, so that it supports the freezing chamber 1 rotatably around its vertical axis.

Figure 2A:
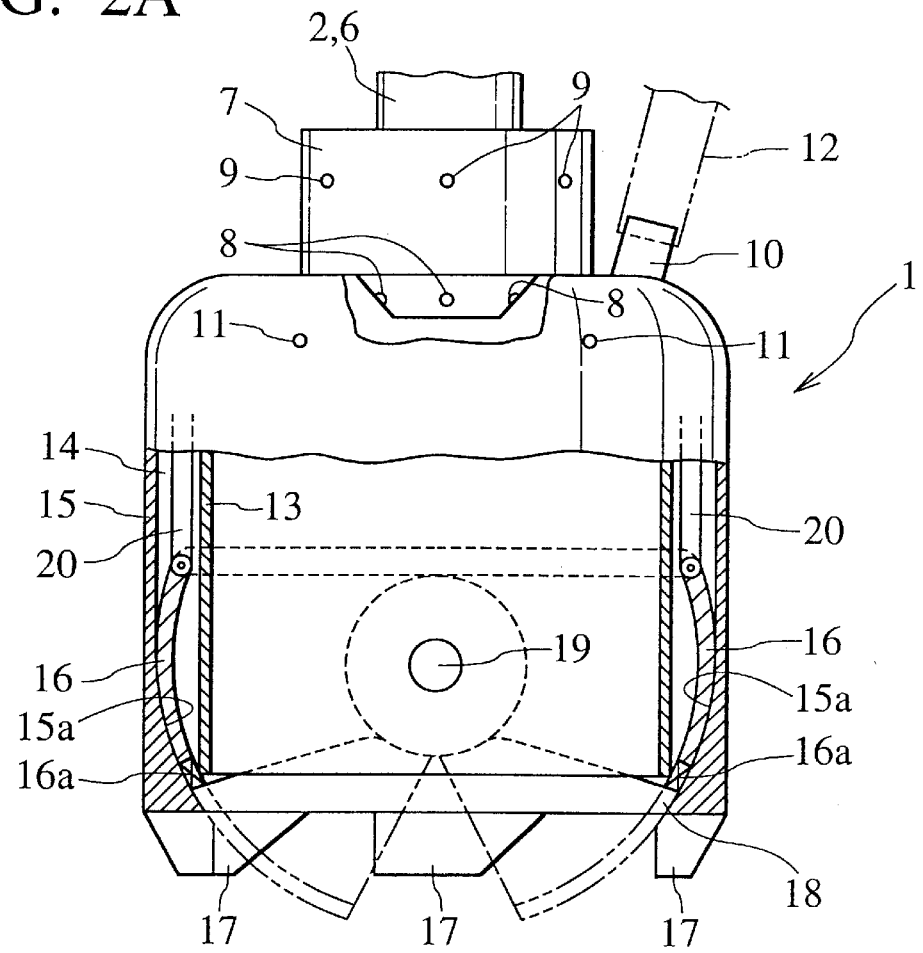
FIG. 2A shows a side sectional view of a freezing chamber.

As shown in FIG. 2A, the freezing chamber 1 is a hollow body having a circular horizontal section and which is open downward. In the center of a top portion thereof is provided a joint portion 7 for the driving shaft 6. Inside/outside water supply portions 8, 9 for supplying water to inside space and outside are spaced at a predetermined interval along the circumference. On the top of the freezing chamber 1 are provided a freezing fluid supply portion 10 for supplying liquefied nitrogen to the inside space as freezing fluid and an appropriate number of gas vent holes 11. A liquefied nitrogen supply hose 12 led from the main body 3 of the driving body 2 is attachable to the freezing fluid supply portion 10.

The side portion of the freezing chamber 1 is constituted of an internal cylinder 13 and an external cylinder 15 such that an annular space 14 is formed between the internal and external cylinders. The annular space 14 accommodates a pair of digging teeth 16, 16 which are capable of progressing from a side portion of the chamber toward an inside of the opening portion. Digging teeth 17 are provided at a predetermined interval along the circumference at the lower end portion.

The external cylinder 15 is formed so as to cover an outside portion of a bottom end portion of the internal cylinder 13 so that inside diameters of the bottom portions of the both cylinders are of substantially the same structure. A groove-like open portion 18 open to the inside of the opening portion is formed between the bottom end portion of the internal cylinder 13 and circumference of the external cylinder 15. Therefore the digging teeth 17 are provided at the bottom end portion of the external cylinder 15.

The two digging teeth 16 are rotatably supported at both their end portions by shafts 19, 19 provided at two positions different by 180° on the side portion of the freezing chamber 1 and formed spherically with the center of the freezing chamber 1 as a center of curvature while bottom end portions thereof are tooth ends 16*a*. On the other hand, inside the external cylinder 15 is formed a groove-like spherical portion 15*a* for holding the central portion of an external face of the spherical digging tooth 16 slidably, in the vertical direction. A rod 20 which is a final portion of the driving power transmitting mechanism provided along the inside of the driving shaft 6 is rotatably coupled with an upper end portion of each digging tooth 16. The driving power transmitting mechanism includes a driving power source in the main body 3 of the driving body 2 or universal joint and is capable of rotating together with the driving shaft 6 and freezing chamber 1.

Figure 2B:
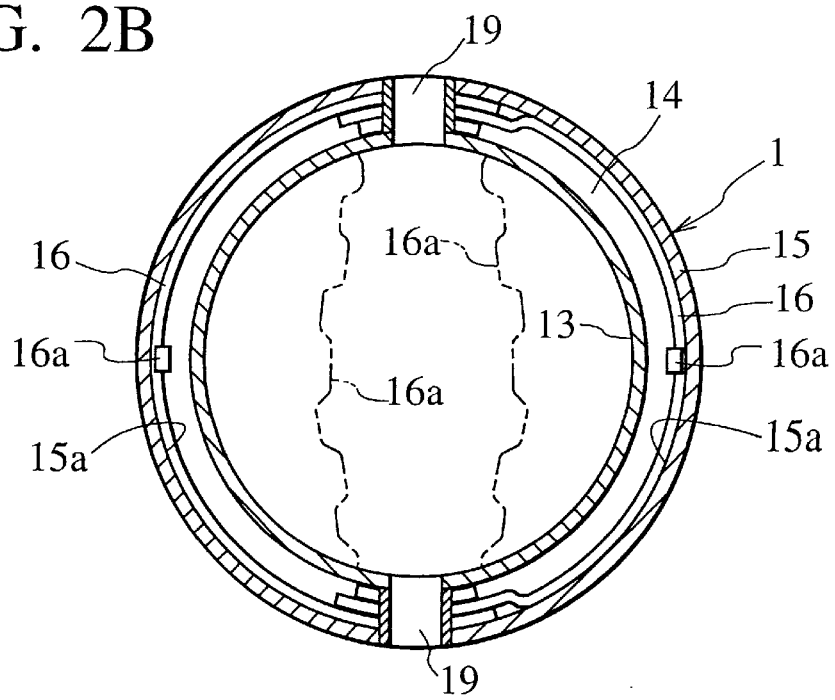
FIG. 2B shows a horizontal sectional view of the freezing chamber.

When each rod 20 is driven downward, both of the digging teeth 16, 16 rotate downward along the curvature and extend from a groove-like releasing portion 18 to the inside of the opening portion of the freezing chamber 1, as shown in FIG. 2A and FIG. 2B by the double-dotted line. When the rod 20 is driven upward, the digging teeth 16, 16 rotate upward so that they are accommodated completely in the annular space 14.

Next, the mine treatment method according to the present invention with an operation of the mine treating apparatus having the above described structure will be described.

First, a buried mine is detected with a mine detector or the like. After the mine is detected, the vehicle A is moved near the mine and then by moving the freezing chamber 1 by the arm 4 of the driving body 2, the position of the freezing chamber 1 is adjusted so that it aligns with the buried mine.

Figure 1A:
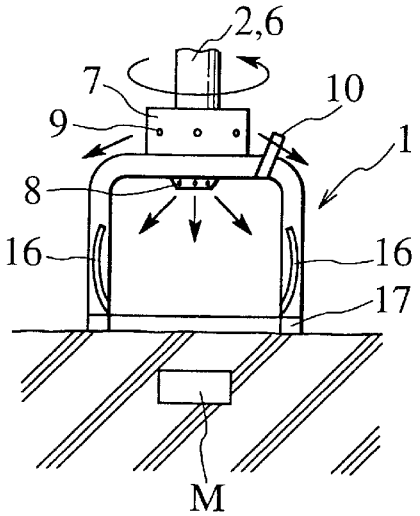
FIGS. 1A, 1B, 1C, 1D, 1E and 1F show sectional views for explaining steps of mine treatment according to the embodiment of a mine treatment method and mine treating apparatus of the present invention.
Figure 1B:
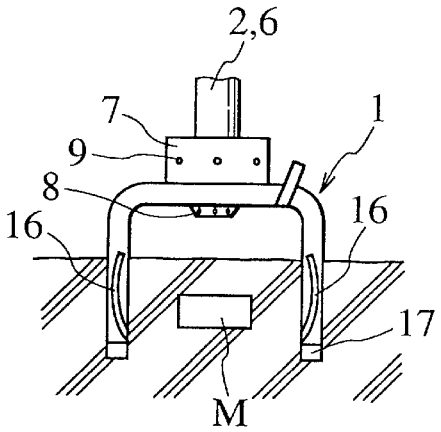
Figure 1C:
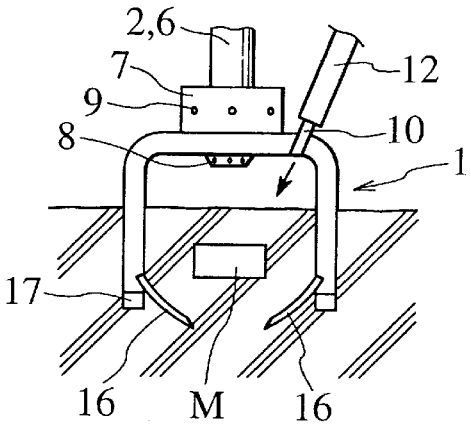
Figure 3F:
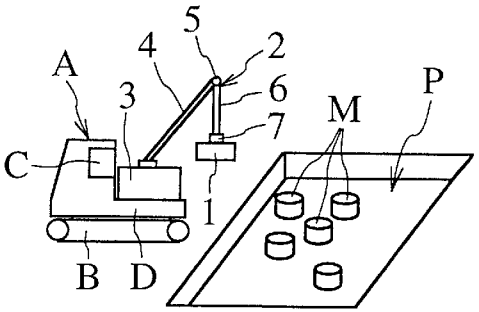

After that, as shown in FIG. 1A, the freezing chamber 1 is rotated around the vertical axis and water is sprayed inside and outside through the water supply portions 8, 9 so as to make water penetrate into soil around the mine M. Then, as shown in FIG. 3B, the driving shaft 6 is expanded while the freezing chamber 1 is being rotated by the driving body 2 and the freezing chamber 1 is pressed down. As a result, by digging the soil by the digging teeth 17, the freezing chamber 1 is driven into the ground. If the mine M is encased inside the freezing chamber 1 as shown in FIG. 1B, the motion of the freezing chamber 1 is stopped.

By making water penetrate into the soil, the soil is softened so that the digging work is smoothed. Further, because the digging is carried out with the freezing chamber 1 being rotated, an influence of vibration and the like upon the mine M is minimized. Further, according to the mine treating apparatus of the present invention, in the freezing chamber 1, the bottom end portion of the external cylinder 15 has a substantially same structure as that of the internal cylinder 13 and the digging teeth 16 are accommodated in the annular space 14 between the internal cylinder 13 and external cylinder 15. Therefore, when the freezing chamber 1 is driven into the ground, the digging teeth 16 never interfere with the ground so that a smooth digging is carried out.

After the above procedure is completed, in the mine treating apparatus, a pair of the digging teeth 16, 16 are rotated in the ground and the same digging teeth 16, 16 are extended from the groove-like releasing portion 18 to the inside of the opening portion of the freezing chamber 1. As shown in FIG. 3C, by closing the opening portion of the freezing chamber 1 halfway, the mine M and surrounding soil are held inside the freezing chamber 1. At this time, in the mine treating apparatus, the digging teeth 16 form spherical shape. Therefore, it is possible to make it easier for the digging teeth 16 to bite the soil by rotating the freezing chamber 1 while the digging teeth 16 are being extended.

Figure 1D:
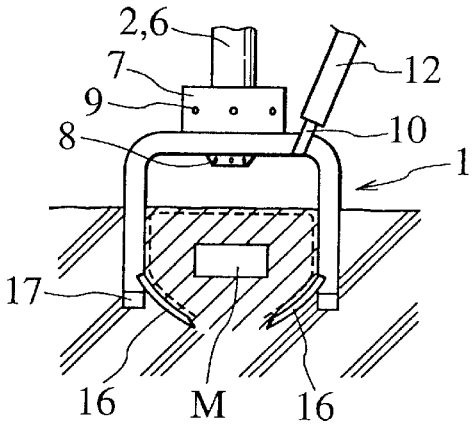

As shown in FIG. 3C, a supply hose 12 introduced from the main body 3 of the driving body 2 is connected to the freezing fluid supply portion 10 of the freezing chamber 1 and liquefied nitrogen is supplied to the inside of the freezing chamber 1. As shown in FIG. 1D, the mine M is frozen together with the surrounding soil. At this time, excessive gas is discharged through the gas vent hole 11. Because according to the mine treatment method and mine treating apparatus of the present invention, water is made to penetrate into the soil before digging, freezing is carried out not only from the surface of the soil but also inside thereof. Therefore, freezing work time can be considerably reduced as compared to a case in which no water is made to penetrate.

Figure 1E:
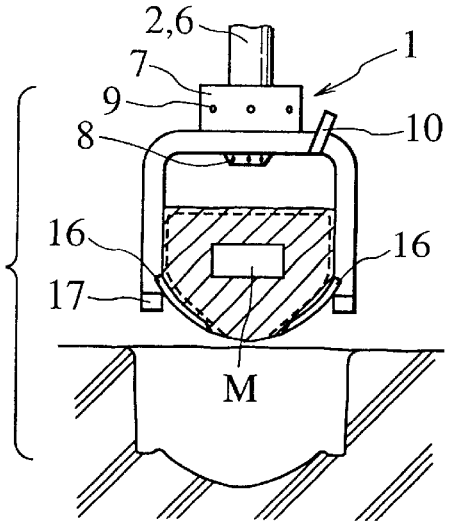
Figure 3E:
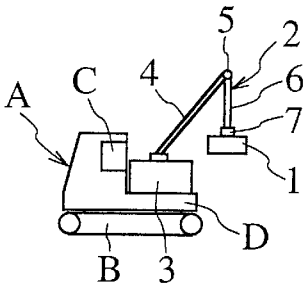
Figure 3B:
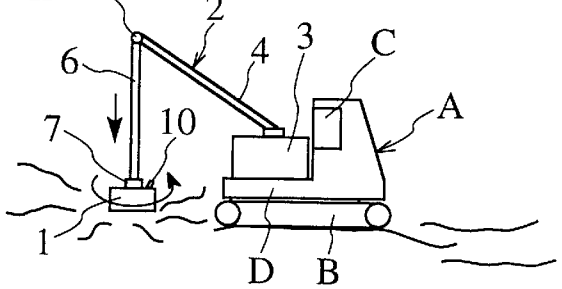
Figure 3C:
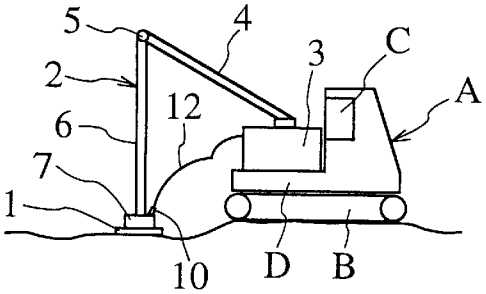
Figure 3D:
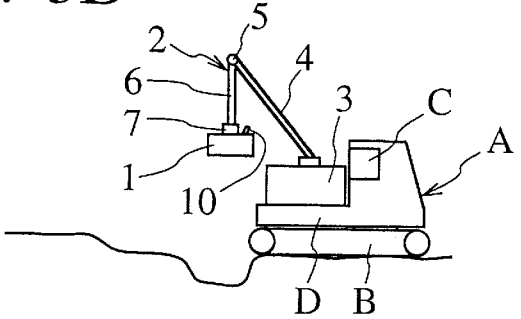

Then, after the freezing, as shown in FIG. 1E and FIG. 3D, the freezing chamber 1 is raised by contracting the driving shaft 6 of the driving body 2 so as to dig up the mine M together with the soil. Although at this time, in a pair of the digging teeth 16, 16 of this embodiment, the tooth ends 16*a*, 16*a* thereof do not mesh with each other completely so that there is a gap therebetween, because the soil inside the freezing chamber 1 is frozen, there is no fear that the mine M and soil will drop.

Figure 1F:
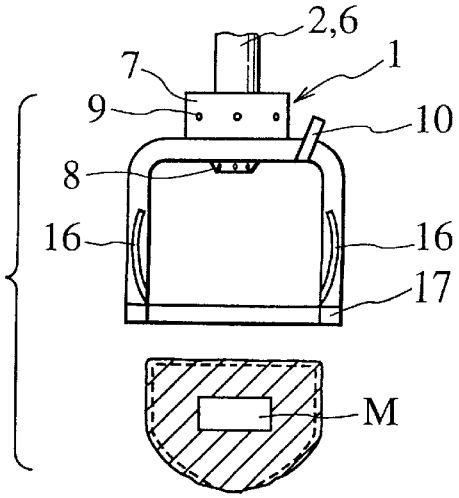

After the mine M is dug out as described above, the mine M is carried by the vehicle A as shown in FIG. 3E. Then, on a mine gathering field P as shown in FIG. 3F, a pair of the digging teeth 16, 16 are drawn inside as shown in FIG. 1F and the opening portion of the freezing chamber 1 is opened and the mine M is thrown together with the soil. At this time, it is recommended to spray water over the outside of the freezing chamber from the water supply portion 9 at the same time when the digging teeth 16 are drawn inside, so as to unfreeze the surface portion of the soil in contact with the freezing chamber so that it slips off easily.

Because according to the mine treatment method and mine treating apparatus of the present invention, the soil around the mine M is frozen and dug out, the mine M can be safely removed in an inoperative condition. Thus, the safety level is much higher than the case of treatment by hand. Further, unlike the mine field exploding apparatus using a rocket, the environment is not restricted. Further, because there is no fear that mine parts are left in the ground, a ground which was before a mine field can be transformed to an agricultural field without any special treatment.

Further because according to the mine treatment method and mine treating apparatus, liquefied nitrogen is used as freezing fluid, not only a sufficient freezing is carried out but also treatment cost is cheap. Further, because the freezing chamber 1 and driving body 2 are loaded on the vehicle A which is a moving means, it is capable of operating as, for example, a mine treatment vehicle for itself, so that an excellent mobility is ensured.

FIGS. 4A and 4B are graphs showing calculated data obtained in freezing the soil accommodated in the freezing chamber 1 by liquefied nitrogen. The freezing chamber 1 is as large as about 50 cm in diameter.

FIG. 4A is a graph showing a relation between a depth of the ground in the center of the freezing chamber 1 and temperature with a passage of where a indicates a time when 10 seconds pass, b indicates a time when 100 seconds pass, c indicates a time when 1,000 seconds pass, and d indicates a time when 10,000 seconds pass. At this time, the ground surface temperature is about −200° C. Because the mine is buried near the surface of the ground in most cases, according to this graph, it is testified that the ground near the mine buried position is completely frozen if, for example, 10,000 seconds pass.

FIG. 4B is a graph showing a relation between the depth of the ground in the center of the freezing chamber 1 and 0° C. arrival time (by solid line) and a relation between a distance from the side portion of the freezing chamber 1 and the 0° C. arrival time (dotted line). In the center of the freezing chamber 1, a depth of about 4 cm is frozen in about 10 minutes. Further, on the side portion of the freezing chamber 1, a range of about 1 cm is frozen in about 10 minutes. The reason for this is that because the freezing chamber is made of metal, it is frozen earlier than the soil, so that the side portion of the freezing chamber 1 in the ground provides an effect of freezing to the surrounding soil.

While preferred embodiments of the present invention have been described using specific terms, such description is for illustrative purposes, and it is to be understood that changes and variations may be made without departing from the spirit or scope of the following claims.

What is claimed is:

1. A mine treatment apparatus, comprising:

a freezing chamber having an opening portion open downwardly, wherein the freezing chamber includes:

digging teeth which extend from the side portion thereof toward the inside of the opening portion; and a freezing fluid supply portion to supply freezing fluid into the internal space of the freezing chamber;

a driving body to drive the freezing chamber into the ground;

an internal cylinder having a circular horizontal section; and an external cylinder having a circular horizontal section, the external cylinder having an inside diameter at the bottom end portion thereof which is substantially the same as the outside diameter at the bottom end portion of the internal cylinder, wherein the digging teeth are a pair of spherical teeth; and wherein the digging teeth extend toward the inside of the opening portion through a groove-like releasing portion formed between the bottom end portions of the internal cylinder and the external cylinder in a rotating manner.

2. The mine treating apparatus according to claim 1, wherein the freezing chamber further includes circular digging teeth at the bottom end portion; and the driving body supports the freezing chamber in such a manner that the freezing chamber is rotatable around the vertical axis of the freezing chamber.

3. The mine treating apparatus according to claim 2, wherein the freezing chamber has a water supply portion to supply water into the internal space thereof.

4. The mine treating apparatus according to claim 3, wherein the freezing chamber and driving body are loaded on a moving means.

5. A mine treatment method treating a mine placed in the ground, comprising the steps of:

adjusting the position of an opening portion of a freezing chamber on the ground around a buried mine so that the freezing chamber aligns with the buried mine;

driving the opening portion of the freezing chamber into the ground while the freezing chamber is rotated;

stopping the driving of the freezing chamber into the ground when the buried mine is encased inside the freezing chamber;

holding the mine and surrounding soil around the mine inside the freezing chamber;

supplying liquefied nitrogen inside the freezing chamber so as to freeze the mine together with the surrounding soil; and raising the freezing chamber so as to dig up the mine together with the surrounding soil.

6. A mine treatment method treating a mine placed in the ground, comprising the steps of:

adjusting the position of an opening portion of a freezing chamber on the ground around a buried mine so that the freezing chamber aligns with the buried mine;

driving the opening portion of the freezing chamber into the ground while the freezing chamber is rotated;

stopping the driving of the freezing chamber into the ground when the buried mine is encased inside the freezing chamber;

holding the mine and surrounding soil around the mine inside the freezing chamber by rotating a pair of digging teeth so that the opening portion of the freezing chamber is halfway closed with the pair of digging teeth;

supplying liquefied nitrogen inside the freezing chamber so as to freeze the mine together with the surrounding soil; and raising the freezing chamber so as to dig up the mine together with the surrounding soil.

7. The mine treatment method according to claim 6, further comprising the step of:

spraying water inside and outside of the freezing chamber so as to make the water penetrate into the soil around the mine before the step of driving the opening portion of the freezing chamber into the ground.

* * * * *